US009673578B1

(12) United States Patent
Lane

(10) Patent No.: US 9,673,578 B1
(45) Date of Patent: Jun. 6, 2017

(54) CABLE-MOUNTED ELECTRICAL CONNECTOR

(71) Applicant: TYCO ELECTRONICS CORPORATION, Berwyn, PA (US)

(72) Inventor: David James Lane, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/148,289

(22) Filed: May 6, 2016

(51) Int. Cl.

| | |
|---|---|
| ***H01R 9/05*** | (2006.01) |
| ***H01R 24/40*** | (2011.01) |
| ***H01R 13/631*** | (2006.01) |
| ***H01R 4/18*** | (2006.01) |
| ***H01R 43/048*** | (2006.01) |
| *H01R 103/00* | (2006.01) |

(52) U.S. Cl.
CPC ..... *H01R 24/40* (2013.01); *H01R 4/183* (2013.01); *H01R 13/631* (2013.01); *H01R 43/048* (2013.01); *H01R 4/188* (2013.01); *H01R 9/0518* (2013.01); *H01R 9/0521* (2013.01); *H01R 9/0524* (2013.01); *H01R 2103/00* (2013.01)

(58) Field of Classification Search
CPC .... H01R 4/188; H01R 9/0518; H01R 9/0521; H01R 9/0524
See application file for complete search history.

(56) References Cited

U.S. PATENT DOCUMENTS

| | | | | |
|---|---|---|---|---|
| 3,184,706 A * | 5/1965 | Atkins | H01R 9/0521 174/89 |
| 6,056,605 A * | 5/2000 | Nguyen | H01R 4/188 439/877 |
| 8,337,262 B2 * | 12/2012 | Ono | H01R 4/185 439/877 |
| 8,366,483 B2 * | 2/2013 | Hardy | H01R 9/0518 439/578 |

* cited by examiner

*Primary Examiner* — Tho D Ta

(57) ABSTRACT

An electrical connector includes an outer contact extending along a longitudinal axis between a front end and a rear end. The outer contact has a terminating segment that extends to the rear end and is configured to engage and be surrounded by a conductive layer of a cable to electrically connect the outer contact to the cable. The terminating segment is cylindrical and defines a chamber therethrough that is configured to receive one or more wires of the cable therein. The terminating segment has a crosshatch pattern along an outer surface thereof. The crosshatch pattern includes multiple grooves extending parallel to one another and multiple cross-grooves extending parallel to one another. The cross-grooves intersect the grooves to define multiple raised panels along the outer surface.

20 Claims, 6 Drawing Sheets

CABLE-MOUNTED ELECTRICAL CONNECTOR

BACKGROUND OF THE INVENTION

The subject matter herein relates generally to electrical connector assemblies.

Radio frequency (RF) connector assemblies have been used for numerous applications including military applications and automotive applications, such as global positioning systems (GPS), antennas, radios, mobile phones, multimedia devices, and the like. The connector assemblies are typically coaxial cable connectors that are provided at the end of coaxial cables.

Some connector assemblies include a housing with a mating interface for coupling to a mating connector. The housing holds a contact assembly that electrically connects to corresponding mating contacts of the mating connector. The contact assembly may be mounted or affixed to a cable, such that the cable extends from a cable end of the housing. One or more electrical contacts of the contact assembly may be terminated, crimped, or otherwise coupled to corresponding conductive elements of the cable to electrically connect the contact assembly of the connector to the cable. The coupling mechanisms are designed to retain the connections and withstand forces that pull the contact assembly away from the cable (and vice versa) without the cable disconnecting from the contact assembly. However, some known connectors do not provide a desirable level of retention force, such that the cable may pull away from the contact assembly responsive to a pulling force that is less than a desirable threshold amount of force. Thus, if the retention force of the connector is exceeded when in use, the electrical connector may break due to the cable being pulled out from the housing, even if the electrical connector remains mated to a mating connector. A need remains for increasing the achievable retention forces for electrical connectors affixed to electrical cables.

BRIEF DESCRIPTION OF THE INVENTION

In one embodiment, an electrical connector is provided that includes an outer contact extending along a longitudinal axis between a front end and a rear end. The outer contact has a terminating segment that extends to the rear end. The terminating segment is configured to engage and be surrounded by a conductive layer of a cable to electrically connect the outer contact to the cable. The terminating segment is cylindrical and defines a chamber therethrough that is configured to receive one or more wires of the cable therein. The terminating segment has a crosshatch pattern along an outer surface thereof. The crosshatch pattern includes multiple grooves extending parallel to one another and multiple cross-grooves extending parallel to one another. The cross-grooves intersect the grooves to define multiple raised panels along the outer surface.

In another embodiment, an electrical connector is provided that includes an outer housing and a contact assembly. The outer housing defines a cavity therethrough that is configured to removably receive a mating connector therein through an opening along a mating end of the outer housing. The contact assembly is disposed within the cavity of the outer housing for engaging and electrically connecting to the mating connector. The contact assembly is mounted to and electrically connected to a cable. The contact assembly includes a center contact terminated to one or more wires of the cable, a dielectric body surrounding the center contact, and an outer contact. The outer contact has a generally cylindrical shape extending between a front end and a rear end. The outer contact defines a chamber that surrounds the dielectric body. The outer contact has a terminating segment that extends to the rear end. The terminating segment engages and is surrounded by a conductive layer of the cable. The terminating segment has a crosshatch pattern along an outer surface thereof. The crosshatch pattern includes multiple grooves extending parallel to one another and multiple cross-grooves extending parallel to one another. The cross-grooves intersect the grooves to define multiple raised panels along the outer surface.

In another embodiment, a method of assembling an electrical connector includes forming an outer contact by rolling a flat metal workpiece into a generally cylindrical shape that extends between a front end and a rear end and defines a chamber therethrough. The outer contact has a terminating segment that extends to the rear end and has a crosshatch pattern along an outer surface thereof. The crosshatch pattern includes multiple grooves extending parallel to one another and multiple cross-grooves extending parallel to one another. The cross-grooves intersect the grooves to define multiple raised panels therebetween along the outer surface. The method includes inserting a center contact and a dielectric body into the chamber of the outer contact. The dielectric body is disposed between the center contact and the outer contact to electrically insulate the center contact and outer contact relative to one another. The method also includes surrounding the terminating segment of the outer contact with a conductive layer of a cable. The method further includes crimping a ferrule around the conductive layer of the cable and the terminating segment of the outer contact to secure and electrically connect the outer contact to the cable.

DETAILED DESCRIPTION OF THE INVENTION

Figure 1:
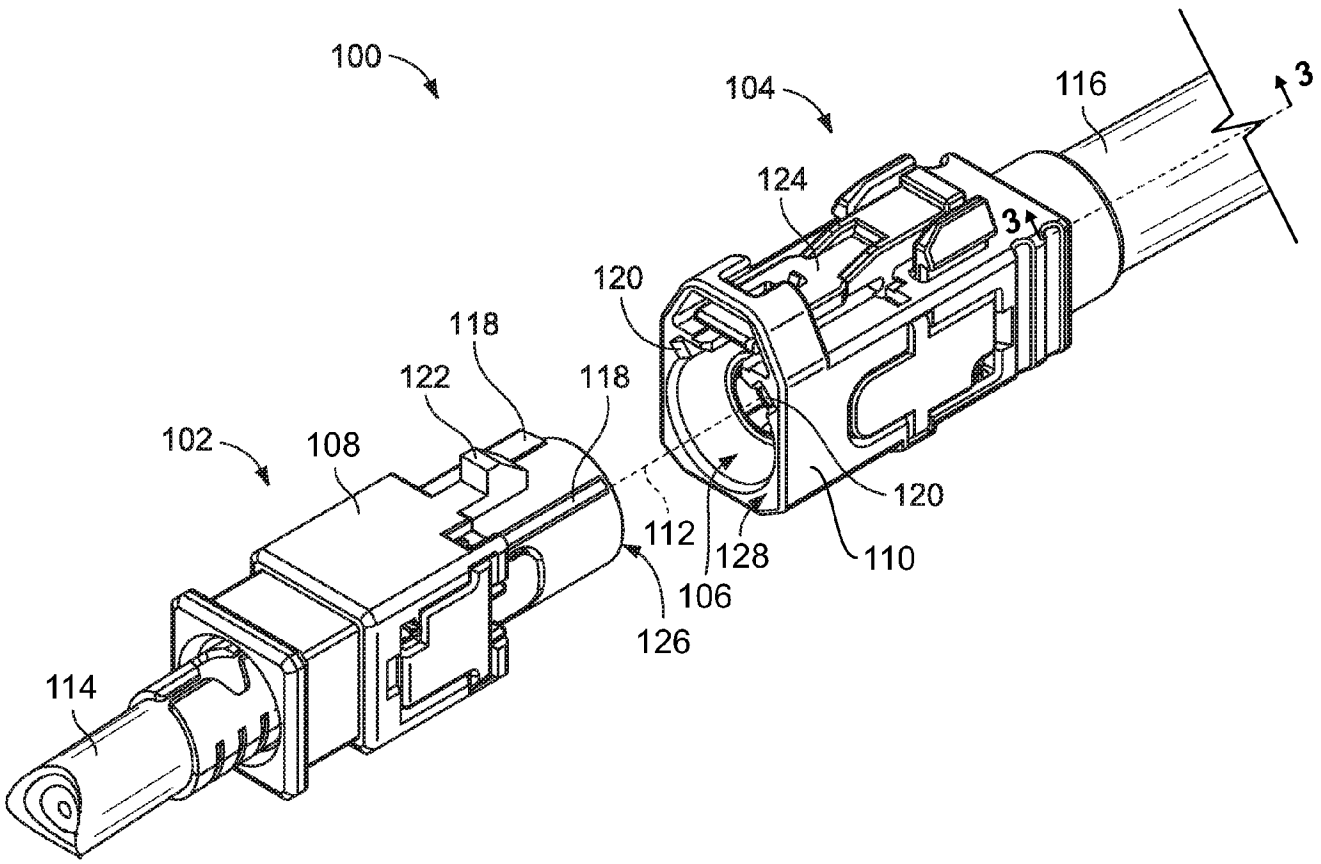
FIG. 1 illustrates a connector system formed in accordance with an exemplary embodiment.

One or more embodiments described herein disclose a connector system that includes a first connector and a second connector. At least one of the first connector or the second connector is mounted to an electrical cable. For example, the first connector and/or the second connector include an outer contact that is crimped to a conductive layer of an electrical cable to affix and electrically connect the respective connector to the cable. The outer contact may be crimped to the conductive layer using a wraparound ferrule that extends around the conductive layer, which surrounds an end segment of the outer contact. The end segment of the outer contact includes a crosshatch pattern along an outer surface thereof that engages an inner side of the conductive layer of the cable. The crosshatch pattern includes multiple grooves and multiple cross-grooves that intersect the grooves to define raised panels along the outer surface of the outer contact.

The crosshatch pattern is configured to increase the grip between the outer contact and the conductive layer to improve amount of retention that the respective connector can provide relative to known cable-mounted connectors. For example, some known connectors include parallel serrations along the outer contact that extend circumferentially around the outer contact in an orientation that is generally perpendicular to a longitudinal axis of the outer contact. When crimped to cable braids, for example, of an electrical cable, the cable braids engage circumferentially-extending ridges along the outer contacts that are defined between adjacent serrations. Such connectors are known to not be able to withstand a desirable amount of force (for example, 120 Newtons (N)) before the cable braids slide off the outer contacts. The raised panels and grooves along the outer surface of the outer contact described herein may improve the achievable retention forces by increasing the friction or interference between the outer contact and the conductive layer of the cable crimped around the outer contact. For example, the crimped connection between the cable and the outer contact having the crosshatch pattern described herein may successfully withstand forces up to and/or in excess of 120 N without breaking.

In one or more embodiments, the outer contact is produced by stamping and forming a panel of sheet metal. The crosshatching pattern may be formed on the outer surface of the outer contact in two stamping operations. For example, a stamping tool may include multiple ridges that form the grooves (for example, a first set of grooves) during a first stamping operation in which the stamping tool strikes the outer contact. The stamping tool may subsequently be rotated relative to the outer contact and then moved to strike the outer contact in a second stamping operation such that the ridges of the stamping tool form the cross-grooves that intersect the grooves. Alternatively, the crosshatch pattern may be formed on the outer contact by rolling a tool across the outer surface of the outer contact or the like instead of stamping the outer contact.

As used herein, the term "surrounding" means extending around a periphery of another object in at least one dimension, such as encircling the object along a segment of the length of the object. The term "surrounding" as used herein does not necessarily require that the surrounded object be completely enclosed or encased by the surrounding object in all dimensions.

FIG. 1 illustrates a connector system 100 formed in accordance with an exemplary embodiment. The connector system 100 includes a first electrical connector 102 and a second electrical connector 104 that are configured to be mated together to transmit electrical signals therebetween. In the illustrated embodiment, the first electrical connector 102 is a male connector, and the second electrical connector 104 is a female connector, such that a portion of the first electrical connector 102 is received within a cavity 106 of the second electrical connector 104 during a mating operation. More specifically, a male housing 108 (e.g., a nose cone) of the first connector 102 is received within the cavity 106 defined by a female housing 110 of the female connector 104. Although shown as un-mated in FIG. 1, the first and second connectors 102, 104 are poised for mating along a mating axis 112. As used herein, the first electrical connector 102 is referred to as male connector 102 or mating connector 102, and the second electrical connector 104 is referred to as female connector 104 or simply as connector 104.

The connector system 100 may be used in numerous applications across various industries, such as the automotive industry, the home appliance industry, the aviation industry, and the like, to electrically couple two or more devices and/or electrical components. For example, in the automotive industry, the electrical connectors 102, 104 may be used for radio frequency communications, such as to electrically connect an antenna to a controller and/or processing device.

The male connector 102 and the female connector 104 each electrically connect to different electrical components and provide a conductive pathway between the corresponding electrical components. In the illustrated embodiment, the male connector 102 and the female connector 104 are mounted and electrically connected to corresponding electrical cables 114, 116, such as coaxial cables. In an alternative embodiment, the male connector 102 or the female connector 104 may be mounted (e.g., edge-mounted) to a corresponding circuit board. The cable 114 is electrically terminated (e.g., crimped, soldered, etc.) to electrical contacts of the male connector 102. The cable 116 is electrically terminated to electrical contacts of the female connector 104. The electrical contacts of the male connector 102 engage the electrical contacts of the female connector 104 when the connectors 102, 104 are mated to transmit various electrical signals conveying power, control messages, data, or the like between the cable 114 and the cable 116.

The male connector 102 and the female connector 104 both have in-line shapes in the illustrated embodiment. For example, the mating axis 112 along which the male connector 102 is loaded into the cavity 106 is generally parallel to the orientations of the cable 114 exiting the male connector 102 and the cable 116 exiting the female connector 104. In an alternative embodiment, the male connector 102 and/or the female connector 104 may have a right angle shape.

In the illustrated embodiment, the male connector 102 and the female connector 104 constitute FAKRA connectors which are RF connectors that have an interface that complies with the standard for a uniform connector system established by the FAKRA automobile expert group. FAKRA is the Automotive Standards Committee in the German Institute for Standardization, representing international standardization interests in the automotive field. The FAKRA connectors have a standardized keying system and locking system that fulfill the high functional and safety requirements of automotive applications. For example, the male connector 102 in the illustrated embodiment has one or more keying ribs 118, and the female connector 104 has one or more keying channels 120 that receive the keying ribs 118 when the connectors 102, 104 are mated. The keying ribs 118 and the keying channels 120 are configured to restrict the mate-ability of each of the connectors 102, 104 to one or more specific mating connectors according to the FAKRA standards. The connector system 100 may utilize other types of connectors other than the FAKRA connectors described herein.

During mating, a front end 126 of the male connector 102 is moved along the mating axis 112 and is plugged into the cavity 106 of the female connector 104 through a front end 128 thereof. As used herein, relative or spatial terms such as "front," "rear," "top," or "bottom" are only used to distinguish the referenced elements and do not necessarily require particular positions or orientations relative to the surrounding environment of the connector system 100. The male connector 102 has a catch 122 that is configured to engage a complementary deflectable latch 124 of the female connector 104 to retain a mating connection between the two connectors 102, 104 (by restricting undesired un-mating of the connectors 102, 104). The latch 124 is configured to be lifted or pivoted over the catch 122 in order to disconnect the male and female connectors 102, 104.

Figure 2:
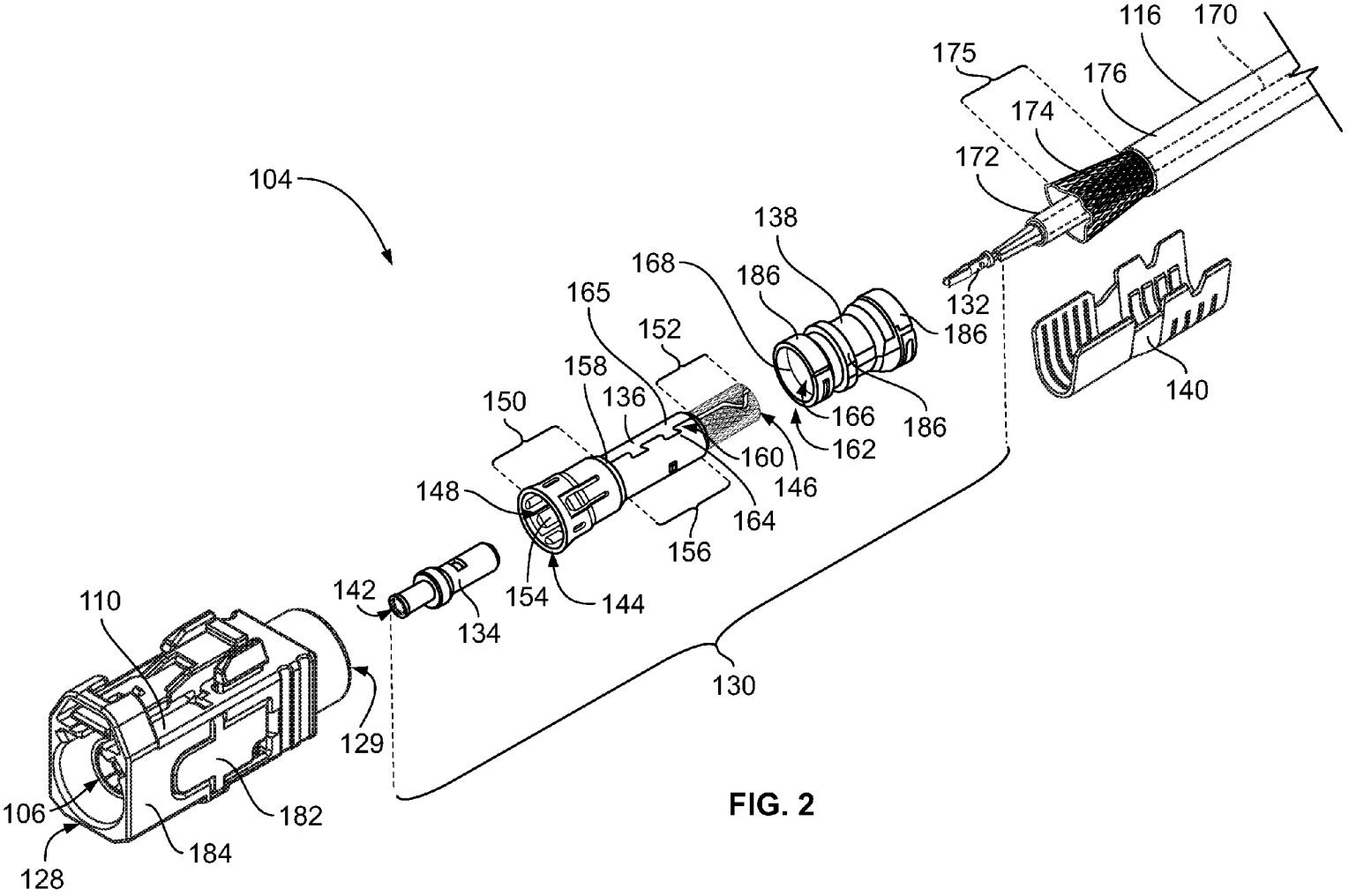
FIG. 2 is an exploded view of a female connector and a cable of the connector system according to an embodiment.

FIG. 2 is an exploded view of the female connector 104 and the cable 116 according to an embodiment. The female connector 104 includes the female housing 110 (also referred to herein as outer housing 110) and a contact assembly 130. The contact assembly 130 is held within the outer housing 110. The contact assembly 130 includes a center contact 132, a dielectric body 134, an outer contact 136, and a cavity insert 138. In other embodiments, the female connector 104 may include one or more additional components and/or may not include all of the listed components. The contact assembly 130 is terminated to the cable 116 via a ferrule 140.

The cable 116 may be a coaxial cable that has a center conductor 170 (for example, one or more electrical wires) surrounded by a dielectric layer 172. The center conductor 170 is shown in phantom in FIG. 2. The center conductor 170 may be composed of copper, silver, aluminum, and/or one or more other metals. Although illustrated in phantom as a single bundle commonly surrounded by the dielectric layer 172, the center conductor 170 may include multiple wires that are individually surrounded by separate insulation layers. The dielectric layer 172 may be composed of one or more plastics to protect and electrically insulate the center conductor 170 from a conductive shield layer 174 that surrounds the dielectric layer 172. The conductive shield layer 174 provides electrical shielding of the signals transmitted along the center conductor 170, and may also provide an electrical grounding path. The conductive shield layer 174 may be or include a cable braid 174 that includes metal strands woven or braided into a layer that surrounds the dielectric layer 172. Optionally, the conductive shield layer 174 may also include a foil layer. As shown in FIG. 2, an end segment 175 of the cable braid 174 is expanded and configured to surround a portion of the outer contact 136. The end segment 175 of the cable braid 174 is configured to be crimped to the outer contact 136 via the ferrule 140 to electrically connect and mechanically couple the cable 116 to the contact assembly 130. A cable jacket 176 surrounds the cable braid 174 and provides protection for the cable braid 174, the dielectric layer 172, and the center conductor 170 from external forces and contaminants.

In the illustrated embodiment, the center contact 132 of the contact assembly 130 constitutes a socket contact that is configured to receive and electrically engage a pin contact of the male connector 102 (shown in FIG. 1). Alternatively, the center contact 132 may be a pin contact or another type of contact. The center contact 132 is composed of a conductive material such as one or more metals. The center contact 132 is terminated to the center conductor 170 of the cable 116, such as via crimping or soldering.

The dielectric body 134 surrounds the center contact 132. For example, the dielectric body 134 defines a passage 142 that receives the center contact 132 therein. The dielectric body 134 is composed of a dielectric material, such as one or more plastics. The dielectric body 134 is configured to extend between the center contact 132 and the outer contact 136 to electrically insulate the contacts 132, 136 from one another.

The outer contact 136 surrounds the dielectric body 134 and the center contact 132 that is within the dielectric body 134. The outer contact 136 is composed of a conductive material such as one or more metals. The outer contact 136 provides shielding for the center contact 132, such as from electromagnetic or radio frequency interference. The outer contact 136 extends between a front end 144 and a rear end 146, and defines a chamber 148 that extends through the outer contact 136 between the front and rear ends 144, 146. The chamber 148 receives the dielectric body 134, and the center contact 132 that is within the dielectric body 134, therein. The chamber 148 may also receive at least portions of the cable 116 therein, such as the center conductor 172 and the dielectric layer 172. The outer contact 136 has a generally cylindrical or barrel shape. For example, the outer contact 136 has a cylindrical shape but may not have a constant diameter along an entire length of the outer contact between the front and rear ends 144, 146. In an embodiment, the outer contact 136 is stamped and formed into the generally cylindrical shape by stamping and then rolling a panel of sheet metal. For example, the outer contact 136 includes a unitary, one-piece body 158 that, when rolled into the cylindrical shape, includes a seam 160 that extends the length of the outer contact 136. The seam 160 is defined between a first rolled edge 164 and an opposite second rolled edge 165 of the body 158. The rolled edges 164, 165 may define complementary tabs and recesses such that the first rolled edge 164 interlocks with the second rolled edge 165 at the seam 160 to hold the cylindrical shape of the outer contact 136.

In an embodiment, the outer contact 136 includes a mating segment 150 that extends rearward from the front end 144 and a terminating segment 152 that extends frontward from the rear end 146. The mating segment 150 is configured to engage an outer mating contact (not shown) of a mating connector, such as the male connector 102 (shown in FIG. 1), during a mating operation. The mating segment 150 may include one or more retention features 154, such as deflectable beams, bumps, barbs, or the like in order to maintain engagement between the mating segment 150 of the outer contact 136 and the outer mating contact. The terminating segment 152 is configured to be electrically connected to the cable braid 174 of the cable 116. For example, the cable braid 174 may surround the terminating segment 152 and may be crimped to the terminating segment 152 via the ferrule 140. In an embodiment, the terminating segment 152 of the outer contact 136 has a crosshatch pattern 190 along an outer surface 192 of the terminating segment 152. The crosshatch pattern 190 is configured to provide enhanced grip on the cable braid 174 of the cable 116 that is crimped around the terminating segment 152, at least relative to known outer contacts that do not include a crosshatch pattern.

Optionally, the outer contact 136 may include a middle segment 156 between the mating segment 150 and the terminating segment 152 along the length of the outer contact 136. The middle segment 156 may have a different diameter than at least one of the mating segment 150 and the terminating segment 152. For example, in the illustrated embodiment, the middle segment 156 has a smaller diameter than the mating segment 150 and a larger diameter than the terminating segment 152. In an alternative embodiment, the terminating segment 152 may have a larger diameter than the middle segment 156, such as if the terminating segment 152 is configured to be crimped to a cable that is larger than the cable 116.

The cavity insert 138 surrounds at least a portion of the outer contact 136. The cavity insert 138 defines a channel 166 that extends through the cavity insert 138, and the outer contact 136 is held within the channel 166. In an embodiment, the outer contact 136 surrounds the middle segment 156 of the outer contact 136. The cavity insert 138 optionally may surround at least a portion of the mating segment 150 and/or the terminating segment 152. The cavity insert 138 is configured to secure the outer contact 136 axially within the channel 166, such that the outer contact 136 does not move axially relative to the cavity insert 138. The cavity insert 138 is an adapter that is configured to engage the outer housing 110 to hold the contact assembly 130 in a fixed axial position within the cavity 106 of the housing 110. For example, the cavity insert 138 may include at least one flange 186 that extends circumferentially along a perimeter of the cavity insert 138. The flange 186 is configured to engage the outer housing 110 within the cavity 106 in order to secure the axial position of the contact assembly 130.

The ferrule 140 is configured to be crimped over the cable 116 to the terminating segment 152 of the outer contact 136. The ferrule 140 provides electrical termination of the cable braid 174 to the outer contact 136 and strain relief for the cable 116. In an exemplary embodiment, the ferrule 140 is configured to be crimped to both the cable braid 174 and the cable jacket 176 of the cable 116.

The female outer housing 110 extends between the front end 128 and a rear end 129. The outer housing 110 has a generally box shaped outer profile. The cavity 106 of the outer housing 110 may be a generally cylindrical bore extending through the outer housing 110 between the front and rear ends 128, 129. The cavity 106 may have steps, shoulders and/or channels formed therein for engaging and securing the cavity insert 138 therein. The outer housing 110 is optionally configured to receive a retainer clip 182 that extends through an opening in a side wall 184 of the housing 110. The retainer clip 182 is configured to be loaded into the housing 110 subsequent to the contact assembly 130 in order to secure the contact assembly 130 to the housing 110. For example, the retainer clip 182 may engage one or more flanges 186 of the cavity insert 138 to secure the axial position of the contact assembly 130 within the cavity 106.

Although the female connector 104 is shown and described in FIG. 2, the male connector 102 (shown in FIG. 1) may have similar and/or identical components as the components of the female connector 104. For example, the male connector 102 may include a contact assembly that is received within the male housing 108 (shown in FIG. 1). The contact assembly of the male connector 102 may include a center contact, a dielectric body, an outer contact, and a cavity insert that are at least similar to the components of the contact assembly 130 described in FIG. 2. For example, an outer contact of the male connector 102 may be similar to the outer contact 136 of the female connector 104 shown and described below.

Figure 3:
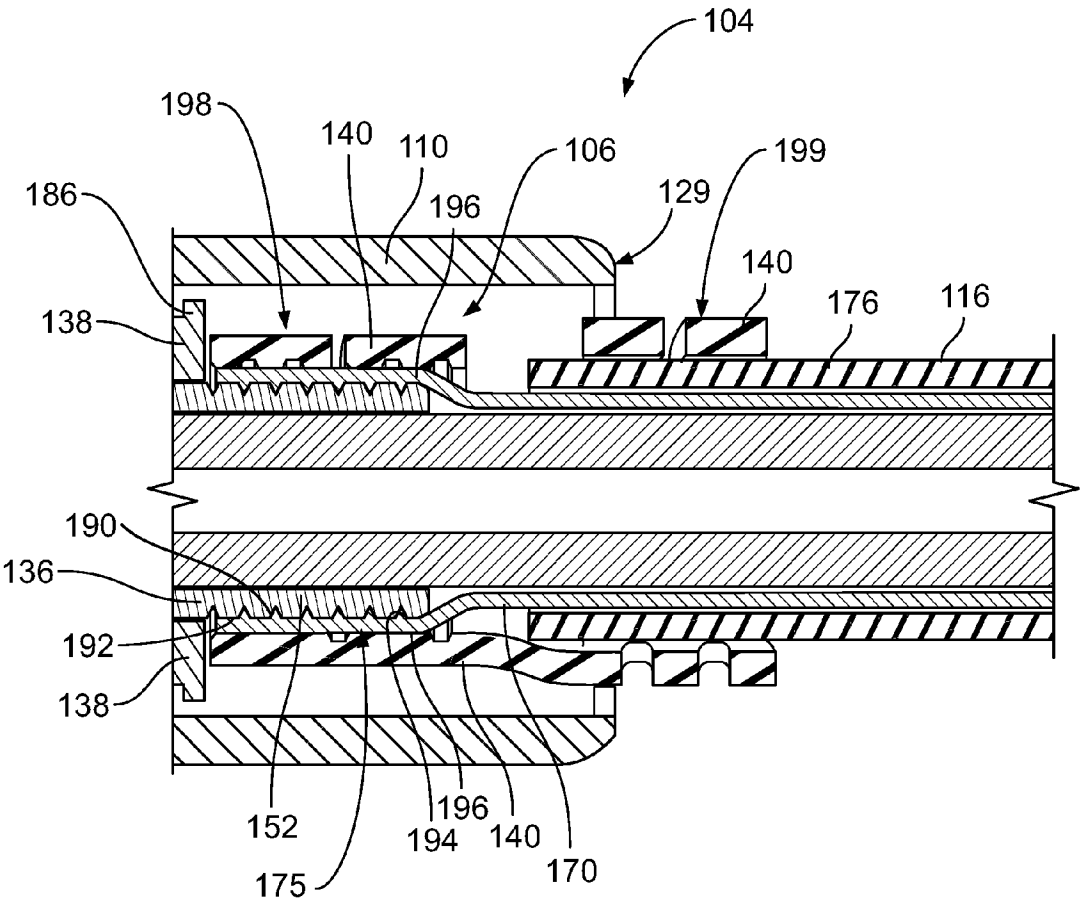
FIG. 3 is a cross-sectional view of a rear portion of the female connector taken along line 3-3 shown in FIG. 1.

FIG. 3 is a cross-sectional view of a rear portion of the assembled female connector 104 taken along line 3-3 shown in FIG. 1. The end segment 175 of the cable braid 174 extends over and surrounds the terminating segment 152 of the outer contact 136. An inner side 194 of the cable braid 174 engages the crosshatch pattern 190 along the outer surface 192 of the terminating segment 152. The cable braid 174 is crimped around the terminating segment 152 via the ferrule 140 to secure the cable braid 174 to the outer contact 136. For example, the ferrule 140 extends around a perimeter of the end segment 175 of the cable braid 174 and engages an outer side 196 of the cable braid 174. Thus, the end segment 175 of the cable braid 174 is sandwiched radially between the terminating segment 152 and the ferrule 140. In the illustrated embodiment, the ferrule 140 includes braid segment 198 that engages the cable braid 174 and a jacket segment 199 that extends around and engages the cable jacket 176.

As shown and described in more detail herein, the crosshatch pattern 190 of the terminating segment 152 may provide enhanced grip on the cable braid 174, which increases the amount of retention force that the connector 104 is able to provide to prevent the cable 116 from being pulled away from the housing 110. For example, crimping the ferrule 140 around the cable braid 174 may cause the protrusions of the crosshatch pattern 190 to dig into the inner side 194 of the braid 174. The crosshatch pattern 190 may increase an amount of contact surface area between the outer surface 192 of the terminating segment 152 and the inner side 194 of the braid 174 relative to known circumferential serrations, which increases friction and retention.

In an embodiment, the cavity insert 138 surrounds a portion of the outer contact 136 and engages the housing 110 to secure the contact assembly 130 (shown in FIG. 2) within the cavity 106 of the housing 110. For example, the cavity insert 138 may engage the retainer clip 182 (shown in FIG. 2) and/or one or more shoulders of the housing 110 within the cavity 106 to secure the cavity insert 138 in the cavity 106.

Figure 4:
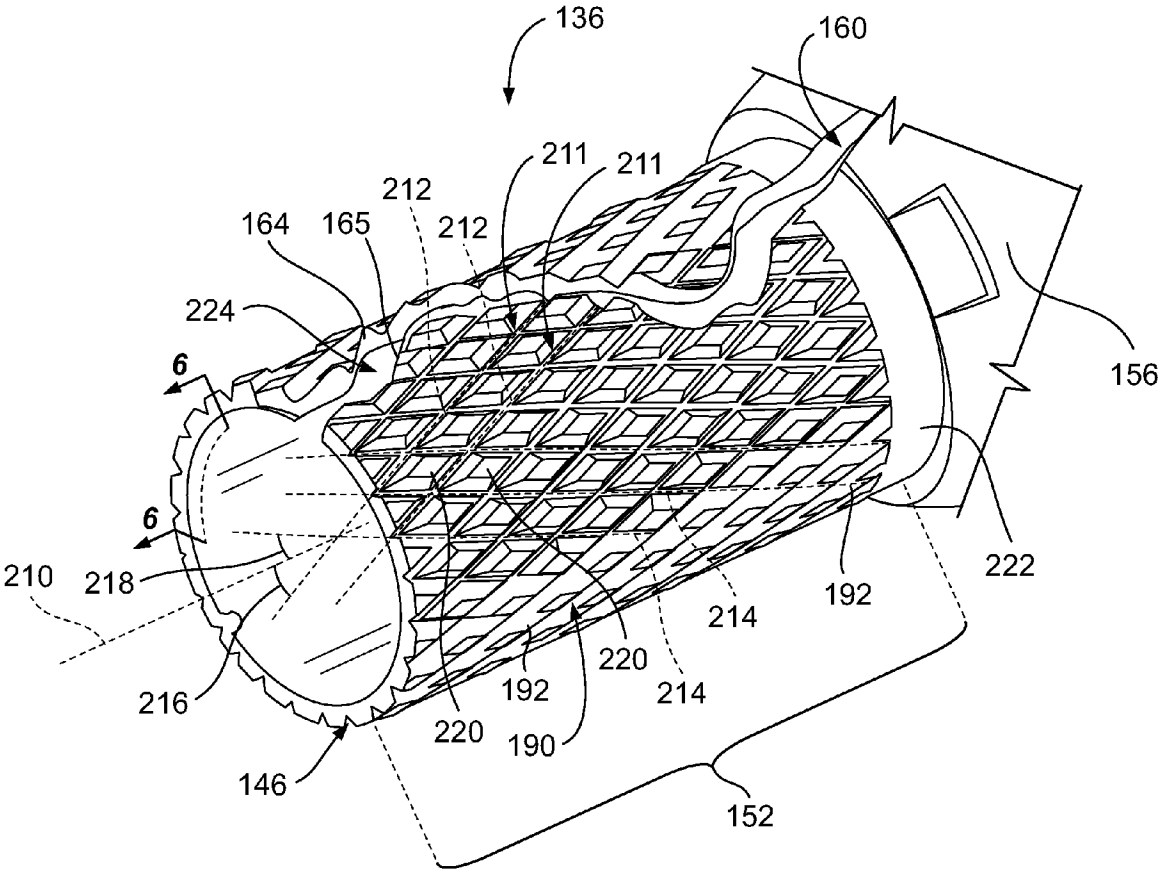
FIG. 4 is a perspective view of a portion of an outer contact of the female connector according to an embodiment.

FIG. 4 is a perspective view of a portion of the outer contact 136 of the female connector 104 according to an embodiment. The illustrated portion includes the terminating segment 152. The outer contact 136, including the terminating segment 152, extends along a longitudinal axis 210. The longitudinal axis 210 extends parallel to the mating axis 112 (shown in FIG. 1) when the female connector 104 is assembled. In an embodiment, the crosshatch pattern 190 includes multiple channels 211 defined along the outer surface 192. The channels 211 include grooves 212 and cross-grooves 214. The cross-grooves 214 intersect the grooves 212 to define multiple raised panels 220 along the outer surface 192 of the terminating segment 152. In the illustrated embodiment, the raised panels 220 are defined between two adjacent grooves 212 and between two adjacent cross-grooves 214 that intersect the two grooves 212. In other embodiments, the raised panels 220 may be defined between three or five intersecting channels 211, for example, instead of between four channels 211.

In the illustrated embodiment, the grooves 212 are parallel to one another. The grooves 212 also extend oblique to the longitudinal axis 210 such that the grooves 212 are neither parallel, nor perpendicular, to longitudinal axis 210. Similarly, the cross-grooves 214 are parallel to one another and extend oblique to the longitudinal axis 210. In an alternative embodiment, the grooves 212 may extend parallel or perpendicular to the longitudinal axis 210, while the cross-grooves 214 remain at oblique angles relative to the longitudinal axis 210 and the grooves 212. The channels 211 extend helically around the terminating segment 152 such that the channels 211 each wrap around at least a portion of the circumference of the terminating segment 152. In an embodiment, the grooves 212 have a first helical angle 216 relative to the longitudinal axis 210, and the cross-grooves 214 have a second helical angle 218 relative to the longitudinal axis 210. In an embodiment, both the first and second helical angles 216, 218 are no greater than 60 degrees. For example, the first and second helical angles 216, 218 may each be no greater than 45 degrees. The angles 216, 218 in the illustrated embodiment are less than 45 degrees. Due to the relatively low helical angles, none of the grooves 212 or cross-grooves 214 individually extends around a full circumference of the terminating segment 152. The channels 211 have respective pitches that are longer than the length of the terminating segment 152 between the rear end 146 of the outer contact 136 and a shoulder 222 between the terminating segment 152 and the middle segment 156. As used herein, pitch refers to the longitudinal distance for a helical channel at a defined helical angle to complete a full loop around the terminating segment 152. Due to the low helical angles, the raised panels 220 are elongated generally in the longitudinal direction. In an alternative embodiment, the helical angle 216 of the grooves 212 and/or the helical angle 218 of the cross-grooves 214 may be greater than 60 degrees or at least greater than 45 degrees.

Figure 5:
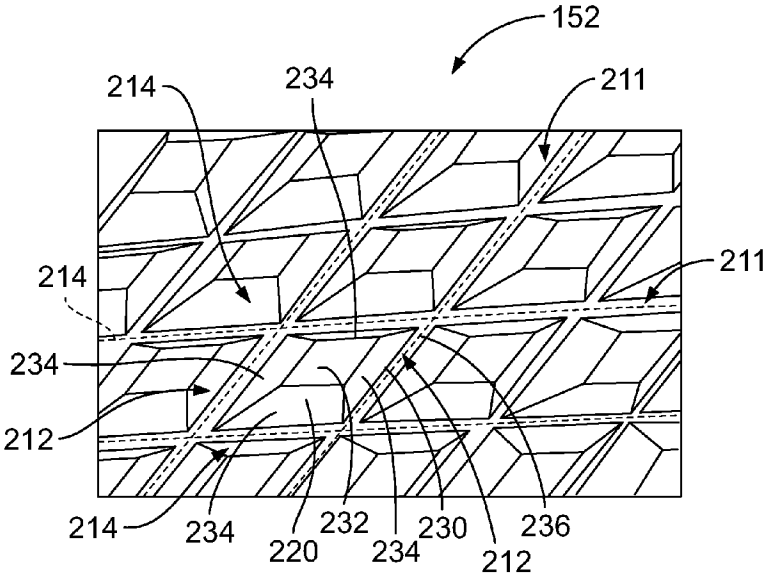
FIG. 5 is a close-up perspective view of a portion of a terminating segment of the outer contact shown in FIG. 4.

In the illustrated embodiment, the first rolled edge 164 along the terminating segment 152 is spaced apart from the second rolled edge 165 to define a gap 224 along the seam 160. The gap 224 may extend along a tortuous or winding path along the length of the terminating segment 152 to the rear end 146 of the outer contact 136. In an embodiment, during a crimping operation that secures the cable braid 174 (shown in FIG. 3) around the terminating segment 152 via the ferrule 140 (FIG. 3), compressive forces on the terminating segment 152 cause the width of the gap 224 to be reduced. The tortuous path of the gap 224 may reduce the likelihood of a portion of the cable braid 174 (or another connector component or cable component) getting pinched between the first and second rolled edges 164, 165 during the crimping operation as the gap 224 narrows. The gap 224 may also support impedance matching between the contact assembly 130 (shown in FIG. 3) and the cable 116 (FIG. 3). As shown in FIG. 5, the crosshatch pattern 190 extends to both the first and second rolled edges 164, 165. The crosshatch pattern 190 may extend around a full circumference of the terminating segment 152 of the outer contact 136 between the rolled edges 164, 165. In an embodiment, the crosshatch pattern 190 is defined along and covers the entire outer surface 192 of the terminating segment 152. Alternatively, the crosshatch pattern 190 is defined along most, but not all, of the surface area of the outer surface 192.

Figure 6:
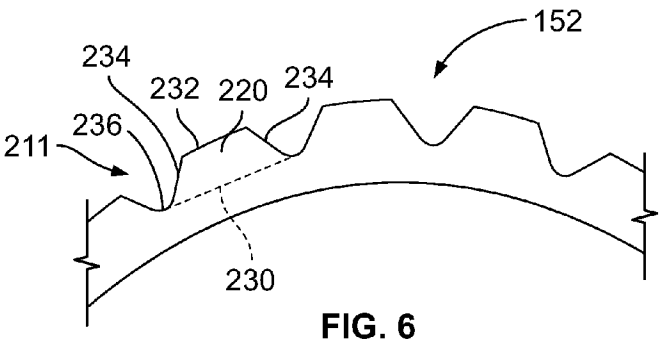
FIG. 6 is a cross-sectional view of a portion of the terminating segment of the outer contact along line 6-6 shown in FIG. 4.

FIG. 5 is a close-up perspective view of a portion of the terminating segment 152 shown in FIG. 4. FIG. 6 is a cross-sectional view of a portion of the terminating segment 152 along line 6-6 shown in FIG. 4. The raised panels 220 have shapes that are defined by the channels 211 that surround each corresponding panel 220. The raised panels 220 are islands of material that are arranged in a pattern. Each panel 220 extends radially outward from a base 230 of the panel 220 to a crest 232. The base 230 is located at the nadirs 236 or deepest points of the corresponding channels 211 that define the panel 220. The panels 220 have parallelepiped structures. For example, each panel 220 includes at least three side walls 234 that each extend between the base 230 and the crest 232. In the illustrated embodiment, the panels 220 have four side walls 234. The side walls 234 of each panel 220 are angled relative to each other such that the panel 220 tapers from the base 230 to the crest 232. For example, the side walls 234 are sloped to extend at least partially towards each other (with increasing height towards the crest 232 relative to the base 230). The crests 232 of the raised panels 220 may be defined by top walls or points. In the illustrated embodiment, the crests 232 are top walls that are generally planar. Since the panels 220 are tapered, the top wall 232 of each panel 220 has a similar shape but a smaller surface area than a footprint of the base 230 of the panel 220. In an alternative embodiment, the panels 220 may taper to points, such that the panels 220 resemble pyramids.

The side walls 234 are defined by the shape of the channels 211. In the illustrated embodiment, the grooves 212 and the cross-grooves 214 have V-shaped cross-sections. In an embodiment, the grooves 212 have the same dimensions as the cross-grooves 214. The side walls 234 are planar in the illustrated embodiment, but may have convex or concave curves in other embodiments.

In the illustrated embodiment, each raised panel 220 has a diamond shape that is defined between two adjacent grooves 212 and two adjacent cross-grooves 214 that intersect the two grooves 212. Each of the four side walls 234 is defined by a different one of the grooves 212 and cross-grooves 214. The panels 220 are tapered such that the diamond-shaped crest 232 is smaller than the diamond-shaped base 230. In an embodiment, all of the raised panels 220 have the same shape and the same size as one another.

Figure 7:
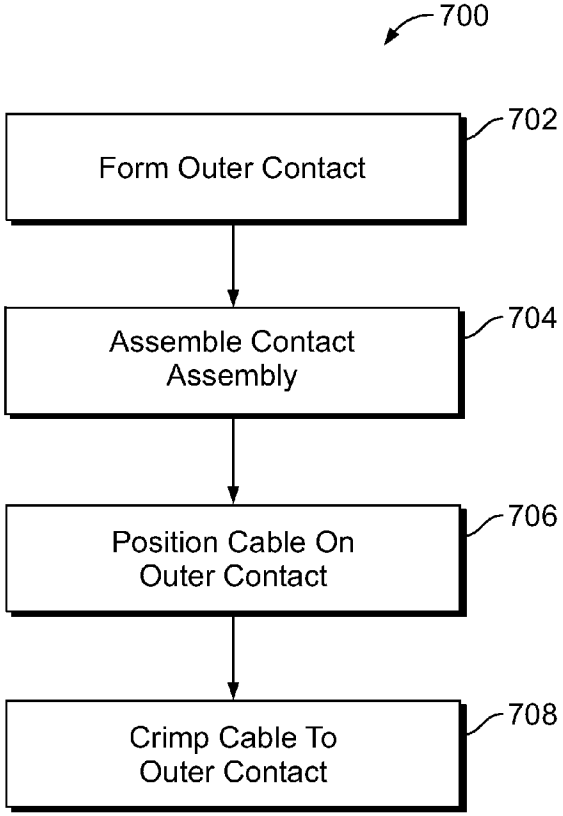
FIG. 7 is a flow chart of a method for assembling an electrical connector according to an embodiment.

FIG. 7 is a flow chart of a method 700 for assembling an electrical connector according to an embodiment. The method 700 may be performed to assemble the female connector 104 or the male connector 102 (both shown in FIG. 1). For example, the components described in the method 700 may be the same as, or similar to, the components of the female connector 104 shown in FIGS. 2-6. At 702, an outer contact is formed. The outer contact is formed by rolling a flat metal workpiece into a generally cylindrical shape. A terminating segment of the outer contact has a crosshatch pattern along an outer surface thereof. The crosshatch pattern includes multiple grooves extending parallel to one another and multiple cross-grooves extending parallel to one another. The cross-grooves intersect the grooves to define multiple raised panels along the outer surface.

Figure 8:
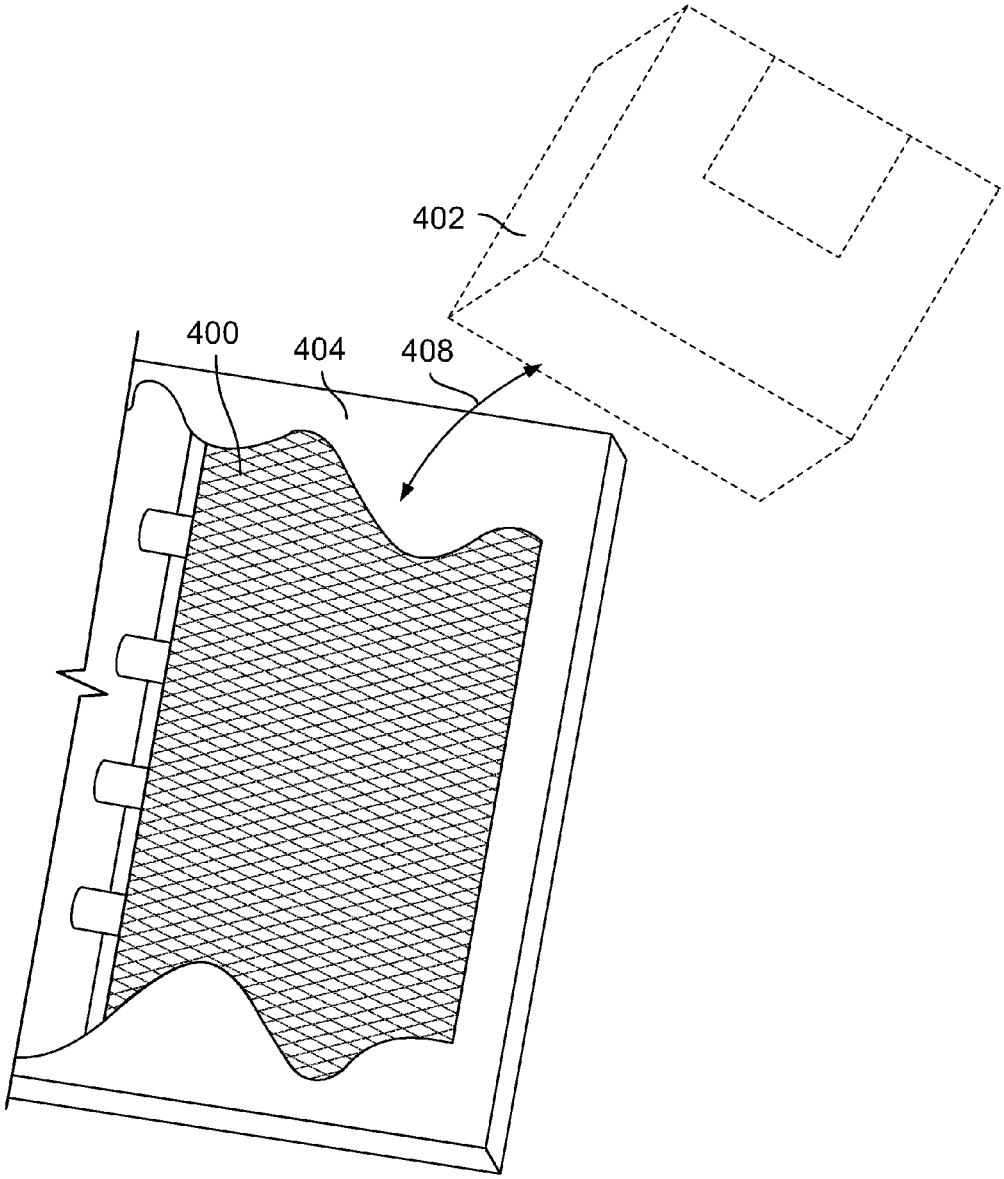
FIG. 8 shows a top perspective view of a portion of a flat workpiece used in the formation of the outer contact according to an embodiment.

Referring now to FIG. 8, FIG. 8 shows a top perspective view of a portion of a flat workpiece 400 used in the formation of the outer contact according to an embodiment. The workpiece 400 is disposed on a support base 404. In an embodiment, the crosshatch pattern is formed on the outer contact by contacting the outer surface of the outer contact with a hatching tool that includes parallel ridges along a working surface thereof. In the illustrated embodiment, the hatching tool is a stamping tool 402 (shown in phantom) that is configured to be pressed into the flat workpiece 400 to define the grooves and cross-grooves. For example, the parallel ridges (not shown) of the stamping tool 402 may form the grooves during a first contact (or pressing) operation. During the contact operation, the stamping tool 402 moves along a contact trajectory 408 and strikes, presses, and/or punches the workpiece 400 on the support base 404. The stamping tool 402 subsequently may be rotated such that the working surface rotates relative to the workpiece, and the same parallel ridge that formed the grooves during the first contact operation may form the cross-grooves during a second contact operation. Alternatively, the workpiece 400 or the support base 404 may be rotated relative to the stamping tool 402 between the first and second contact operations. In an alternative embodiment, the stamping tool 402 may include both ridges that form the grooves and separate ridges that form the cross-grooves such that only a single contact operation is needed to define the crosshatch pattern on the workpiece 400. In another embodiment, the hatching tool may be a roller that has ridges on a wheel, and the crosshatching pattern is formed by rolling the wheel on the workpiece 400.

In the illustrated embodiment shown in FIG. 8, after the crosshatch pattern is formed on the flat workpiece 400, the workpiece 400 is rolled into a generally cylindrical shape to define the formed outer contact (for example, as is shown in FIGS. 2 and 3). In an alternative embodiment that is not shown, a flat workpiece may be rolled into the cylindrical shape of the outer contact prior to forming the crosshatch pattern by contacting the workpiece with the hatching tool. For example, since the cylindrical outer contact may be relatively pliable, a support member, such as a rod, may be inserted into a chamber of the outer contact at least along the terminating segment prior to contacting the outer surface of the outer contact with the hatching tool. The hatching tool may then contact the terminating segment to define the crosshatch pattern, and the support member may engage inner surfaces of the terminating segment to maintain the generally cylindrical shape of the outer contact during the formation process of the crosshatch pattern.

At 704, a contact assembly is assembled. The contact assembly is at least partially assembled by inserting a center contact and a dielectric body into a chamber of the outer contact. The dielectric body is disposed radially between the center contact and the outer contact to electrically insulate the center contact and the outer contact relative to one another. At 706, a cable is positioned on the outer contact. More specifically, a conductive layer of the cable is loaded on and around the terminating segment of the outer contact to surround the terminating segment. The conductive layer may be a conductive braid. At 708, the cable is crimped to the outer contact. For example, a ferrule is crimped around the conductive layer of the cable and the terminating segment of the outer contact (within the conductive layer) during a crimping operating. The crimping operation secures and electrically connects the outer contact to the cable.

The cable-mounted electrical connectors described herein are configured to provide enhanced grip between the outer contact of the connectors and the conductive layer of the cable that is terminated to the outer contact. The enhanced grip may allow the electrical connectors to withstand a desired amount of pulling force that pulls the cable away from the connector, such as at least 120 N. The outer contacts may be stamped and formed, which may allow the cable-mounted electrical connectors described herein to be lighter, smaller, and/or less expensive to produce than known connectors that have die-cast outer contacts.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

an outer contact extending along a longitudinal axis between a front end and a rear end, the outer contact having a terminating segment that extends to the rear end, the terminating segment configured to engage and be surrounded by a conductive layer of a cable to electrically connect the outer contact to the cable, the terminating segment being cylindrical and defining a chamber therethrough that is configured to receive one or more wires of the cable therein, the terminating segment having a smooth inner surface that defines a contour of the chamber, the terminating segment having a crosshatch pattern along an outer surface that is opposite to the smooth inner surface, the crosshatch pattern including multiple grooves extending parallel to one another and multiple cross-grooves extending parallel to one another, the cross-grooves intersecting the grooves to define multiple raised panels along the outer surface, the raised panels configured to be pressed into an inner surface of the conductive layer of the cable to secure and electrically connect the outer contact to the cable.

2. The electrical connector of claim 1, wherein each raised panel has a diamond shape defined between two of the grooves and between two of the cross-grooves that intersect the two grooves.

3. The electrical connector of claim 1, wherein each raised panel extends radially outward from a base to a crest and includes at least three side walls extending between the respective base and the respective crest, the side walls of a corresponding raised panel being angled relative to one another such that the raised panel tapers from the base to the crest.

4. The electrical connector of claim 3, wherein the crest of each raised panel is defined by at least one of a point or a top wall.

5. The electrical connector of claim 1, wherein the grooves and the cross-grooves extend oblique to the longitudinal axis.

6. The electrical connector of claim 1, wherein the grooves and the cross-grooves define respective helical angles relative to the longitudinal axis, the helical angles of the grooves and the helical angles of the cross-grooves being no greater than 45 degrees.

7. The electrical connector of claim 1, wherein the grooves and the cross-grooves have V-shaped cross-sections.

8. The electrical connector of claim 1, wherein the outer contact has a unitary, one-piece body that is stamped and formed into a cylindrical shape, the outer contact including a seam defined between a first rolled edge and an opposite second rolled edge of the body, the crosshatch pattern along the terminating segment extending a full circumference of the outer contact between the first rolled edge and the second rolled edge such that the grooves and cross-grooves are open to the seam at the first and second rolled edges.

9. The electrical connector of claim 8, wherein the first rolled edge is spaced apart from the second rolled edge along the terminating segment to define a gap, the gap extending along a tortuous path, a width of the gap between the first and second rolled edges configured to be reduced responsive to crimping the terminating segment to the cable.

10. The electrical connector of claim 1, wherein none of the grooves or cross-grooves extend around a full circumference of the terminating segment.

11. An electrical connector comprising:

an outer housing defining a cavity therethrough that is configured to removably receive a mating connector therein through an opening along a mating end of the outer housing; and a contact assembly disposed within the cavity of the outer housing for engaging and electrically connecting to the mating connector, the contact assembly mounted to and electrically connected to a cable, the contact assembly comprising:

a center contact terminated to one or more wires of the cable;

a dielectric body surrounding the center contact; and an outer contact having a generally cylindrical shape extending between a front end and a rear end, the outer contact defining a chamber that surrounds the dielectric body, the outer contact having a terminating segment that extends to the rear end, the terminating segment engaging and being surrounded by a conductive layer of the cable, the terminating segment having a smooth inner surface that defines a contour of the chamber, the terminating segment having a crosshatch pattern along an outer surface that is opposite to the smooth inner surface, the crosshatch pattern including multiple grooves extending parallel to one another and multiple cross-grooves extending parallel to one another, the cross-grooves intersecting the grooves to define multiple raised panels along the outer surface, the raised panels configured to be pressed into an inner surface of the conductive layer of the cable to secure and electrically connect the outer contact to the cable.

12. The electrical connector of claim 11, wherein the terminating segment of the outer contact is oriented along a longitudinal axis, the grooves and the cross-grooves extending oblique to the longitudinal axis.

13. The electrical connector of claim 11, wherein each raised panel has a diamond shape defined between two of the grooves and between two of the cross-grooves that intersect the two grooves.

14. The electrical connector of claim 11, wherein the conductive layer of the cable is a cable braid, the cable braid extending around the terminating segment such that an inner side of the cable braid engages the crosshatch pattern, the cable braid being secured to the terminating segment via a ferrule that is crimped around an outer side of the cable braid.

15. The electrical connector of claim 11, wherein the contact assembly further includes a cavity insert surrounding the outer contact, the cavity insert engaging the outer housing to secure the contact assembly within the cavity of the outer housing.

16. The electrical connector of claim 11, wherein the outer contact has a unitary, one-piece body that is stamped and formed into a cylindrical shape, the outer contact including a seam defined between a first rolled edge and an opposite second rolled edge of the body, the crosshatch pattern along the terminating segment extending a full circumference of the outer contact between the first rolled edge and the second rolled edge such that the grooves and cross-grooves are open to the seam at the first and second rolled edges.

17. A method of assembling an electrical connector comprising:

forming an outer contact by rolling a flat metal workpiece into a generally cylindrical shape that extends between a front end and a rear end and defines a chamber therethrough, the outer contact having a terminating segment that extends to the rear end, the terminating segment having a smooth inner surface that defines a contour of the chamber;

forming a crosshatch pattern along an outer surface of the terminating segment of the outer contact, the crosshatch pattern including multiple grooves extending parallel to one another and multiple cross-grooves extending parallel to one another, the cross-grooves intersecting the grooves to define multiple raised panels therebetween along the outer surface;

inserting a center contact and a dielectric body into the chamber of the outer contact, the dielectric body disposed between the center contact and the outer contact to electrically insulate the center contact and outer contact relative to one another;

surrounding the terminating segment of the outer contact with a conductive layer of a cable; and crimping a ferrule around the conductive layer of the cable and the terminating segment of the outer contact such that the raised panels are pressed into an inner surface of the conductive layer of the cable to secure and electrically connect the outer contact to the cable.

18. The method of claim 17, wherein the crosshatch pattern is formed on the outer contact by contacting the outer surface of the outer contact with a hatching tool that includes parallel ridges along a working surface thereof, the parallel ridges forming the grooves in the outer surface of the outer contact during a first contact operation, the working surface being rotated subsequent to the first contact operation and prior to a second contact operation, the parallel ridges forming the cross-grooves in the outer surface of the outer contact during the second contact operation.

19. The method of claim 17, wherein the crosshatch pattern is formed on the flat metal workpiece of the outer contact prior to rolling the workpiece into the generally cylindrical shape.

20. The method of claim 17, wherein the crosshatch pattern is formed on the outer contact subsequent to rolling the workpiece into the generally cylindrical shape, a support member being inserted into the chamber of the outer contact along the terminating segment to maintain the generally cylindrical shape of the outer contact as the crosshatch pattern is formed along the outer surface of the terminating segment.

* * * * *